United States Patent [19]

Hendriksen

[11] 4,141,285

[45] Feb. 27, 1979

[54] NOZZLE FOR DRAWING OFF WELDING FUMES

[76] Inventor: Henrik V. Hendriksen, 3120 Andebu, Norway

[21] Appl. No.: 793,722

[22] Filed: May 4, 1977

[51] Int. Cl.[2] ..... F23J 11/08

[52] U.S. Cl. ..... 98/115 R; 15/307

[58] Field of Search ..... 15/306 A, 307, 415 R, 15/415 A, 418, 420; 37/58; 98/40 N, 115 VM, 115 R; 118/63; 228/57; 302/34, 58; 239/597

[56] References Cited

U.S. PATENT DOCUMENTS

| | | | |
|---|---|---|---|
| 1,034,304 | 7/1912 | Runnion et al. | 239/537 |
| 1,129,817 | 2/1915 | Tangeman | 15/307 |
| 1,543,297 | 6/1925 | Robinson | 15/306 A |
| 1,759,804 | 5/1930 | Pieron | 15/307 X |
| 2,534,189 | 12/1950 | Wright | 15/415 R |
| 3,134,129 | 5/1964 | Allen | 15/418 X |

FOREIGN PATENT DOCUMENTS

| | | | |
|---|---|---|---|
| 817290 | 10/1951 | Fed. Rep. of Germany | 15/307 |
| 169329 | 8/1934 | Switzerland | 15/307 |
| 730768 | 5/1955 | United Kingdom | 15/307 |

*Primary Examiner*—Evon C. Blunk
*Assistant Examiner*—James L. Rowland
*Attorney, Agent, or Firm*—Hubbell, Cohen, Stiefel & Gross

[57] ABSTRACT

A nozzle assembly for drawing off welding fumes at a welding site. The assembly comprises an elongate tubular element having a longitudinal slot defined between two inwardly directed flanges, the tubular element being capable of axial telescopic extension in at least one direction. The tubular element is connected to a tube which leads in use to a suction fan for drawing off the fumes through the slot. The connection of the tube to the tubular element can be made opposite the slot or at one end of the element. The assembly includes means for closing the other end or ends of the element.

6 Claims, 5 Drawing Figures

NOZZLE FOR DRAWING OFF WELDING FUMES

The invention relates to a nozzle assembly for use in drawing off welding fumes at a weld.

During the welding of metal sheets, for example, so-called welding fumes are developed which, in large quantities, can endanger the health of the welder. During the welding of rust-proof material, heavy-metal vapors are developed; during protective-gas welding large concentrations of ozone and nitrous gases are developed; and there is a great generation of fumes during welding with shielded-arc electrodes. Many attempts have been made, therefore, to remove these gases, and for this purpose provision has been made for powerful ventilation when welding is carried out in workshops, for example. However, the problem cannot be solved in this manner in, for example, shipyards. Various point-suction systems have therefore been developed so that the welding fumes can be drawn off from, for example, the welding pistol itself, or, at the electrodes. All these embodiments, however, have suffered from various disadvantages.

At present, the most effective drawing-off is achieved with a suction nozzle which is connected to a flexible tube which leads to a suction fan, the suction nozzle having a gap of 3 to 4 mm width and being placed between 3 and 5 cm. from the welding joint. The nozzle is held, for example, by means of magnets. The system requires the welder to move the suction member every time he moves the electrodes and is therefore somewhat awkward and cumbersome to use. In addition, the nozzle may be unwieldy at certain welding points, so that it may be necessary to use a different nozzle for a particular special purpose or refrain from using a welding nozzle altogether at certain places.

According to the present invention a nozzle assembly for drawing off welding fumes at a welding site, comprises an elongate tubular element with a longitudinal slot defined between two inwardly directed flanges, the tubular element being capable of axial telescopic extension in at least one direction, and having means to connect to a tube which leads in use to a suction fan for drawing the fumes through the slot, the tube connecting with the tubular element at a point opposite the slot or at one end of the element; and including means for closing the other end or ends of the element.

Preferably the tubular element is symmetrical about a central longitudinal plane and includes a planar region, for resting the nozzle assembly on a flat surface, provided on the outer surface of the tubular element adjacent at least one of the flanges.

Thus, the disadvantages of the known welding nozzle assemblies are overcome and a better suction can be achieved than with these known types. Additinally, the suction nozzle can be flexible in its use so that it can be used in places where access is difficult, while at the same time providing a sufficient length so that it is not necessary to move the nozzle assembly as frequently as before. The telescoping of the nozzle assembly also makes the assembly easy to carry.

In use, the nozzle can be extended from its relatively short telescoped length by pulling out one of the telescoping sections and extra extension parts which fit over or inside the tubular element can also be carried to extend the range over which suction can be achieved. The design of the opening slot with inwardly directed flanges has proved in experiments to afford a particularly favorable suction effect so that it is possible to double the suction distance in comparison with known nozzles, so that the nozzle assembly can be placed at a distance of up to 8 cm. from the weld point. This of course facilitates access during welding. The connecting suction tube can be fitted atone end by a connection with an end piece, or it can connect at a central portion of the tubular element.

Additionally, there is the advantage that the width of the slot can be constant over the whole length of the tubular element thus providing equal suction conditions along its length.

Examples of nozzle assemblies according to the invention will now be described with reference to the accompanying drawings in which.

Figures 1, 2:
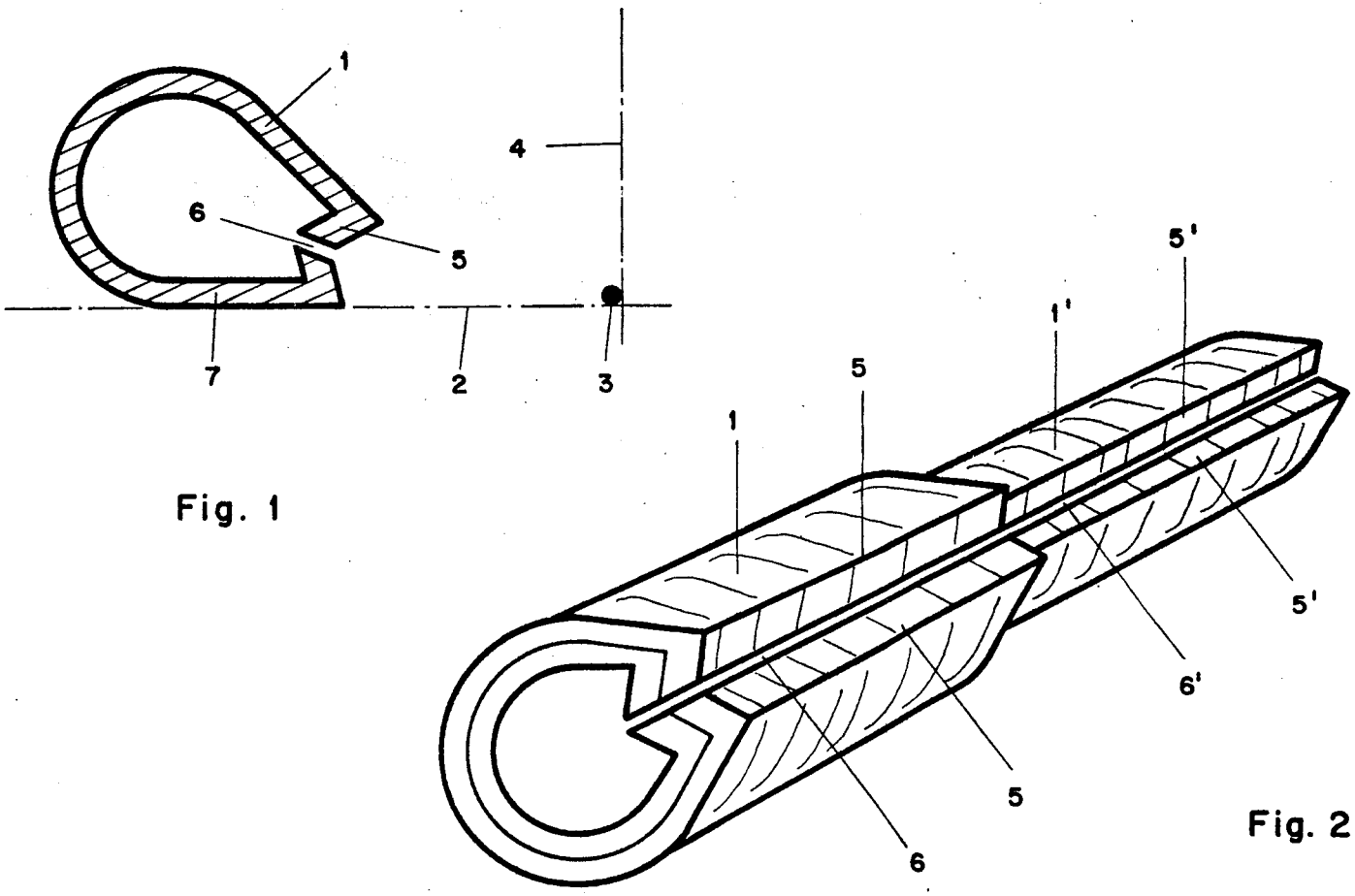
FIG. 1 is a cross-section of the general profile of the nozzle assembly shown placed on a flat surface near a welding point.
FIG. 2 shows a perspective view of a simple tubular element which can be extended telescopically.

FIG. 1 shows a section through a tube profile or tubular element 1 which constitutes the basic element of the nozzle assembly of the invention. The nozzle is placed on a table or other flat surface and may be secured to this surface by means of magnetic devices (not shown). The nozzle is placed at a distance of up to 8 cm. from a welding point 3 where a welding connection is to be formed with a plate 4, which is, like the table or other flat surface 2, shown only schematically in the drawing. At the inlet suction side the tube profile 1 has two inwardly directed flanges 5 which form between them a slot opening 6. The external included angle between the two flanges is preferably between 90° and 100° which has proved to be most suitable suction angle providing a particularly favorable suction effect, enabling the nozzle assembly to be placed further from the weld than has formerly been possible.

In the example shown the tubular element is generally of a circular cross-section but includes tangential extensions towards the slot 6 so that a region 7 for resting the nozzle on a flat surface is formed on both sides. Thus the nozzle can also be used lying in the opposite direction on its other side. It should be pointed out, however, that this is not the only possible profile for such a nozzle since the tube profile may also be bevelled or have another differently curved shape.

FIG. 2 shows the telescopic assembly of two like tube profiles, the tube profile 1' being identical to the tube profile 1, but having its external dimensions corresponding to the internal dimensions of the tube profile 1 so that it can be inserted to slide in the tube profile 1. The tube profiles 1, 1' are preferably equipped with stop members (not shown) so that the profile 1' cannot come completely out of the profile 1. The slots 6 and 6' will have precisely the same width and flanges 5 and 5' will both have the same opening angle, so that the only difference is that the flanges 5' do not project so far as the flanges 5. However, that is of minor importance. In order to complete the nozzle, end pieces may then be fitted to the profiles, in which case one end piece may be constructed with a tube coupling, or the profile 1 can be equipped with a coupling connection for the suction tube to the fan.

Figure 3:
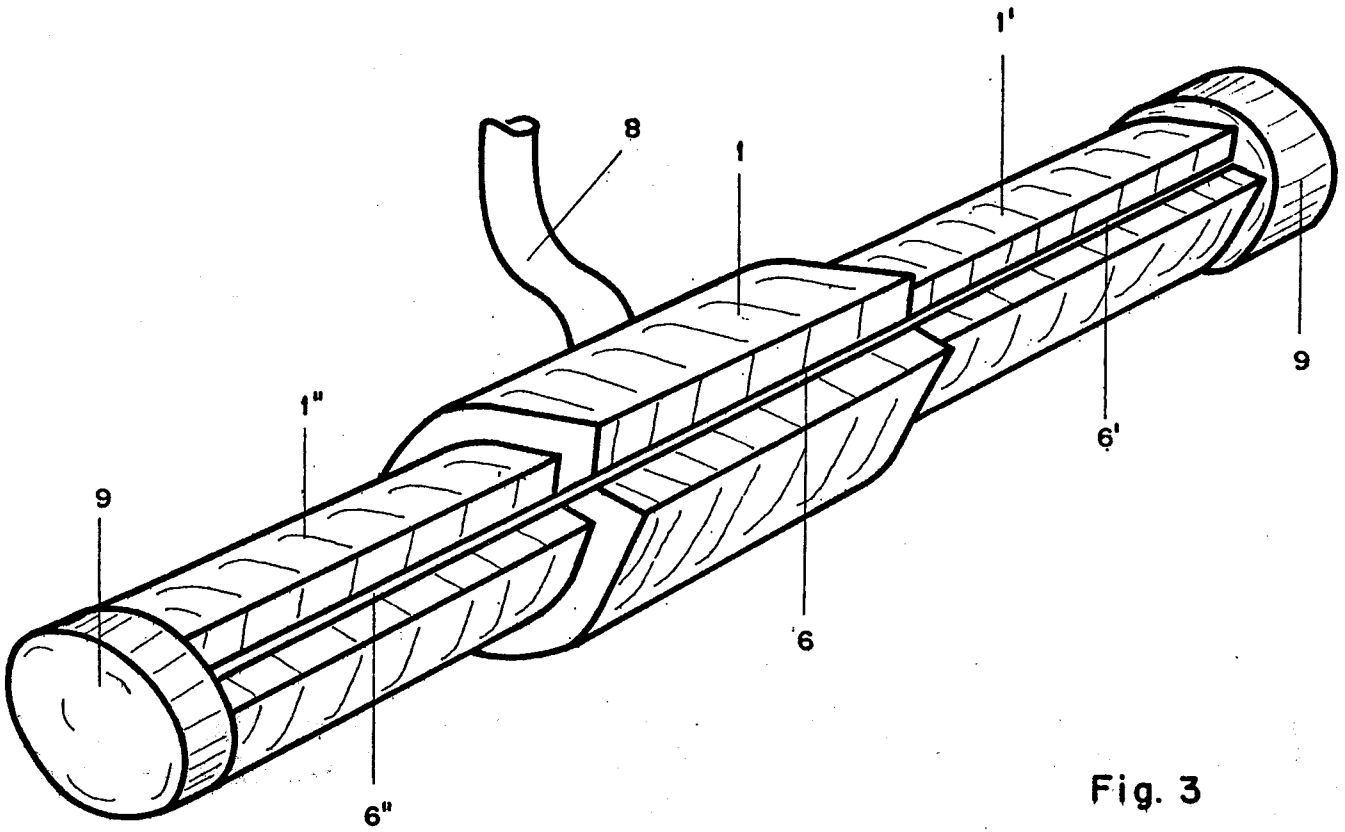
FIG. 3 shows a doubly extensible nozzle assembly with end pieces fitted and a drawing-off point in the middle.
Figure 3A:
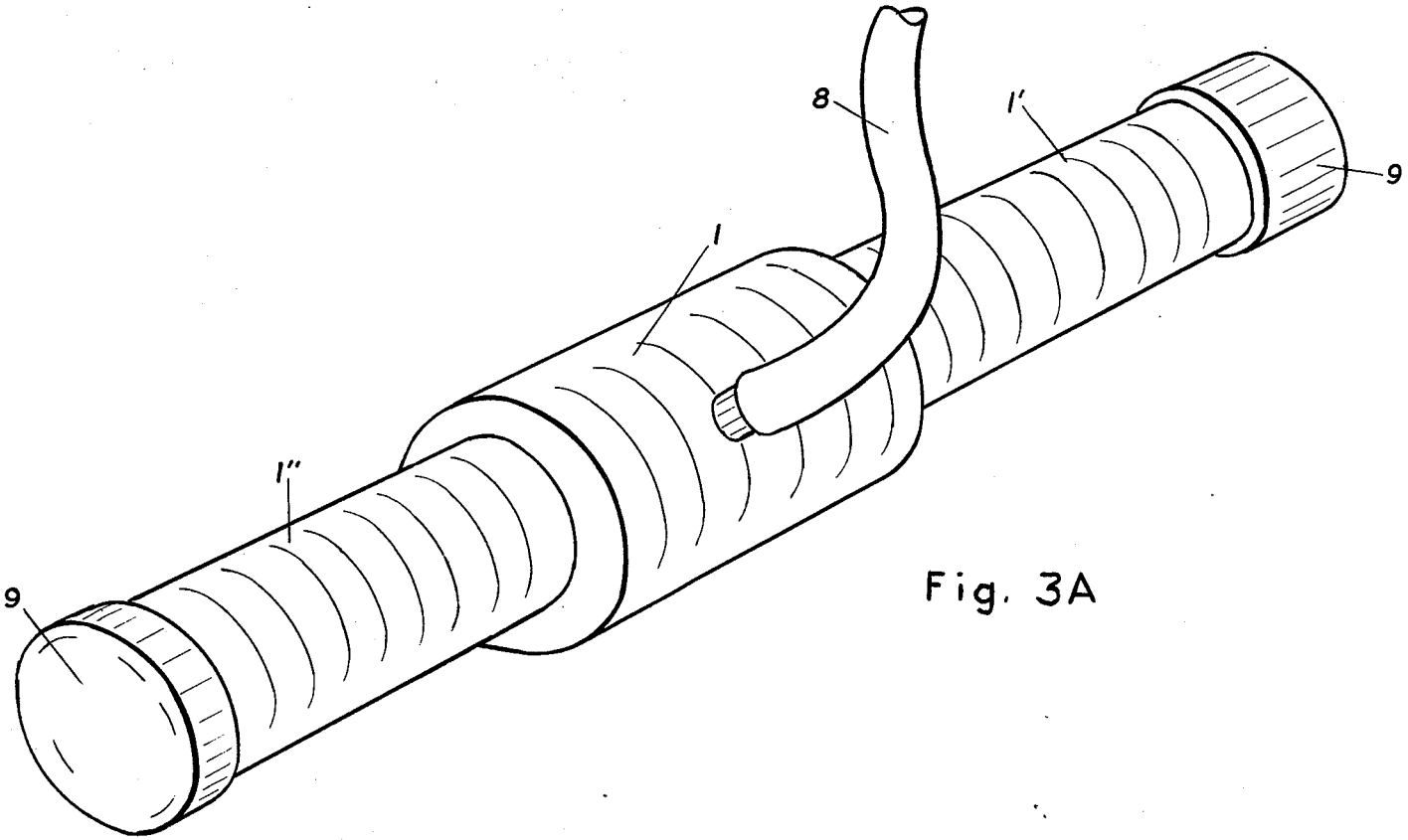
FIG. 3A shows the assembly of FIG. 3 rotated 180° to show where the drawing-off tube is connected in the middle opposite the slot.

Such a completed assembly is shown in FIG. 3 and 3A, which show an example which is telescopic in both directions and where a central suction connection is used for coupling to the tube 8. While the nozzle is being carried to the welding site, part 1' may be telescoped into the part 1, and part 1'' may also be brought along and inserted into position at the welding site, if such a long length is needed. Each end piece 9 may, for example, be constructed in such a manner that it can form a closure both for the larger profile 1 and for the smaller 1''. A detent to prevent part 1'' from sliding out of part 1 can be constructed, for example, so that it can be snapped into position.

Figure 4:
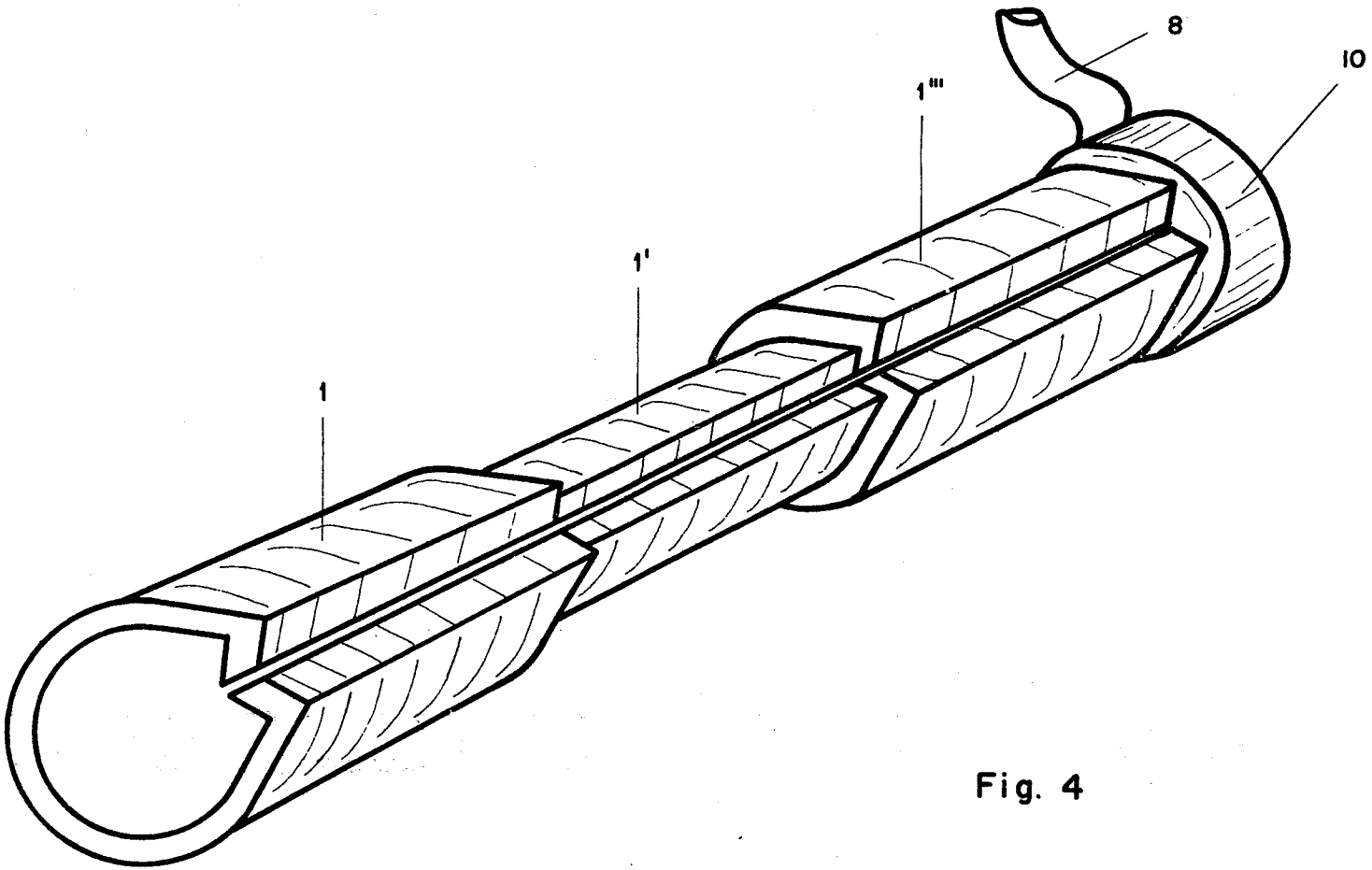
FIG. 4, shows another doubly telescopic nozzle assembly without the end piece being shown, but with the suction tube for the drawing off of the welding fumes fitted at one end.

FIG. 4 shows another possible assembly of the profiles. Here, profile 1 is mounted on the extreme left, while fitted to profile member 1' is a further extension 1'''. Fitted to the end of tube profile 1''' is an end piece 10 which is manufactured with a coupling connection for suction tube 8. If an even longer nozzle is required, it can be extended by adding further similar profile members at the left-hand side of profile 1. The coupling connection (not shown) for tube 8 in profile 1 can be closed with a suitable cap. It is clear that the suction power in tube 8 must be regulated in accordance with the length of the nozzle used. This modular nozzle assembly affords very great flexibility in its possible uses, while at the same time it is constructed in such a manner that the slot width is maintained constant as is the flange intake angle which produces a particularly favorable suction effect with increased suction distance.

I claim:

1. A suction nozzle assembly of the type used to draw off welding fumes adjacent a welding site when connected in fluid conducting relation to a flexible tube which leads in fluid conducting relation to a suction fan, wherein the improvement comprises an elongate tubular element having first and second open ends, said tubular element further having two mutually adjacent inwardly directed longitudinal flanges which define a slot therebetween which slot extends in a longitudinal direction for the entire length of said tubular element from the first open end to the second open end; means for telescopically adjusting the length of said tubular element in a longitudinal direction so that said slot always extends the full adjusted length of said tubular element; means for closing the ends of said element; and means for connection of said nozzle assembly to said tube; so that the entire length of said suction nozzle and the slot are correspondingly adjusted concomitantly; whereby said welding fumes may be drawn off along the entire length of said slot.

2. A nozzle assembly according to claim 1, wherein said means for connection of said nozzle assembly to said tube is provided at a point on said tubular element opposite said slot.

3. A nozzle assembly according to claim 1, wherein said means for connection of said nozzle assembly to said tube is provided at a point on one of said means for closing the ends.

4. A nozzle assembly according to claim 1, wherein said tubular element is symmetrical about a central longitudinal plane.

5. A nozzle assembly according to claim 1, wherein said tubular element includes a tangential planar region on the outer surface of said tubular element adjacent one of said flanges.

6. A nozzle assembly according to claim 1, wherein said flanges form an external included angle of between 90° and 100° with one another.

* * * * *